US006165029A

United States Patent [19]

Lu

[11] Patent Number: 6,165,029

[45] Date of Patent: Dec. 26, 2000

[54] PEDAL BOAT

[76] Inventor: Hsueh-Liang Lu, 5F-1, No. 15, Tzu Chiang St., Yungho City, Taipei Hsien, Taiwan

[21] Appl. No.: 09/348,052

[22] Filed: Jul. 6, 1999

[51] Int. Cl.[7] ..... B63H 16/18

[52] U.S. Cl. ..... 440/30; 440/42

[58] Field of Search ..... 440/30, 31, 42, 440/40

[56] References Cited

U.S. PATENT DOCUMENTS

| | | | |
|---|---|---|---|
| D. 419,952 | 2/2000 | Copeland et al. | D12/306 |
| 1,522,390 | 1/1925 | Sanders | 440/30 |
| 1,576,409 | 3/1926 | Cashoty | 440/30 |
| 3,570,436 | 3/1971 | Le Vasseur | 114/315 |
| 3,624,737 | 11/1971 | Keller | 440/42 |
| 3,675,612 | 7/1972 | Pfeiffer | 440/42 |
| 4,643,685 | 2/1987 | Nishida | 440/42 |
| 5,308,268 | 5/1994 | Schmid | 440/30 |

FOREIGN PATENT DOCUMENTS

| | | | |
|---|---|---|---|
| 1573871 | 12/1967 | France | 440/30 |
| 25571 | of 1897 | United Kingdom | 440/30 |

*Primary Examiner*—S. Joseph Morano
*Assistant Examiner*—Andrew D. Wright
*Attorney, Agent, or Firm*—Dougherty & Troxell

[57] ABSTRACT

A pedal boat mainly includes a hull equipped with a transmission mechanism and a steering mechanism. A tubular member is connected behind a lower rear end of the hull. The transmission mechanism includes a driving chain wheel, a gearbox, and a propeller connected to the gearbox via a shaft and located in the tubular member. The driving chain wheel can be rotated by use of two pedals connected thereto. Power generated by the rotating chain wheel is transmitted to the propeller via the gearbox at a high transmission gear ratio, so that the propeller rotates at high speed and expels water from the tubular member to move the pedal boat quickly in directions controlled by the steering mechanism. The propeller is located under water and would not splash water about to wet a user of the boat when it works. The pedal boat is manhandled by pedaling but capable of moving at high speed and is therefore an interesting water sport means.

4 Claims, 3 Drawing Sheets

PEDAL BOAT

BACKGROUND OF THE INVENTION

The present invention relates to a pedal boat, and more particularly to a pedal boat that can be effortlessly operated to move at a quick speed and is therefore more interesting for use.

There is a wide range of water sports, such as surfboarding, water skiing, water motorcycling, pedal boating, etc. While these water sports create a lot of funs, they are subject to some conditions. For example, the surfboarding would require seashore having heavy waves, the water skiing would require a fast motorboat to tow the water-skier, and a water motorcycle is expensive and tends to cause environmental pollution and is usually forbidden to a scenic lake. A pedal boat is manhandled and does not need an external force to tow it, nor will it cause any environmental pollution. However, the pedal boat moves slowly and is less interesting compared with other water sports.

A conventional pedal boat includes a hull having two rotary wheels provided at two sides of the boat. The rotary wheels have a diameter larger than a height of the boat and include a plurality of blades. The rotary wheels are brought by chain wheels to rotate. A user applies force on pedals to rotate the chain wheels that in turn rotate the rotary wheels, and blades on the rotary wheels propel the boat through the water. Since the rotary wheels have a diameter larger than the height of the boat, the user would have to exert a lot of strength to drive the boat forward and the boat can move only at a very slow speed. Moreover, the blades always splash water about when they come out of the water and undesirably wet the user. As a result, most users are not interested in pedal boating.

It is therefore tried by the inventor to develop an improved pedal boat to eliminate the drawbacks existing in the conventional pedal boat to attract more users.

SUMMARY OF THE INVENTION

A primary object of the present invention is to provide a pedal boat that can move at a high speed and would not splash water to wet the user.

The pedal boat provided by the present invention includes a hull equipped with transmission mechanism and steering mechanism. A tubular member is connected behind a lower rear end of the hull. The transmission mechanism includes a driving chain wheel, a gearbox, and a propeller connected to the gearbox and located in the tubular member. The driving chain wheel can be rotated by use of two pedals connected thereto. Power generated by the rotating chain wheel is transmitted to the propeller via the gearbox at a high transmission gear ratio, so that the propeller rotates at high speed and expel water from the tubular member to move the pedal boat quickly in directions controlled by the steering mechanism. The propeller is located under water and would not splash water about to wet a user of the boat when it works. The pedal boat is manhandled by pedaling but capable of moving at high speed and is therefore an interesting water sport means good for training the user's body.

DETAILED DESCRIPTION OF THE PREFERRED EMBODIMENTS

Figure 1:
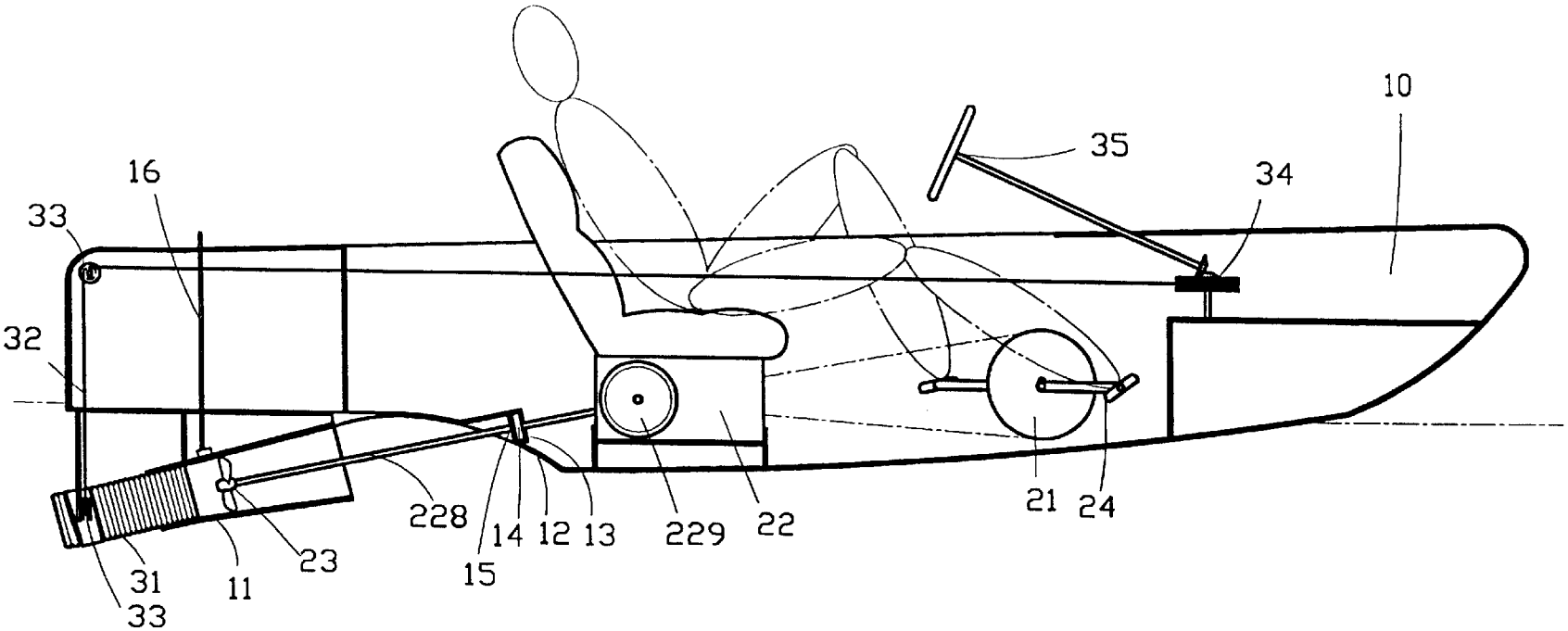
FIG. 1 is a side plan view showing the overall structure of the pedal boat according to the present invention.

Please refer to FIG. 1 that shows a pedal boat according to the present invention. As shown, the pedal boat mainly includes a hull 10 equipped with a transmission mechanism 20 and a steering mechanism 30.

The pedal boat has a backward reduced tubular member 11 connected behind a lower rear end of the hull 10. An area of the lower rear end of the hull 10 facing an expanded front opening of the tubular member 11 forms an inward curved flow-guiding surface 12. Water flow near a bottom of the hull 10 is guided by the curved flow-guiding surface 12 into the tubular member 11. A bearing support 13 is provided on the flow-guiding surface 12 at a predetermined position for a bearing 14 and a watertight washer 15 to mount thereto.

Figure 2:
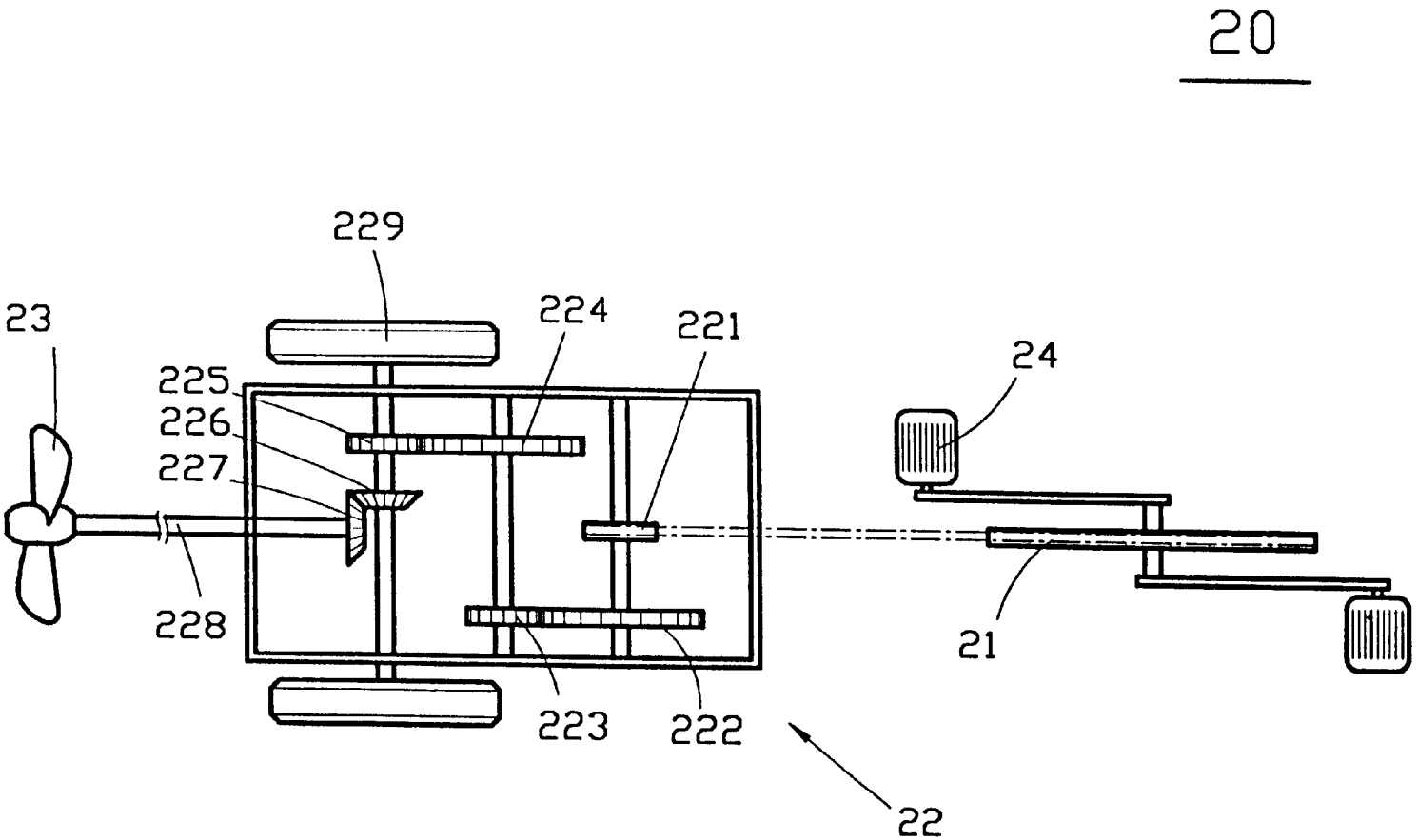
FIG. 2 is a top view of the transmission mechanism of the pedal boat of FIG. 1.
Figure 3:
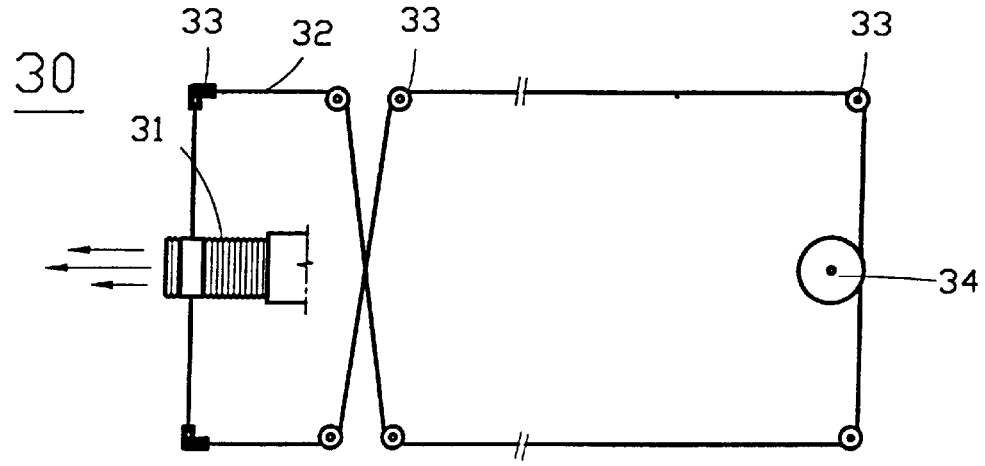
FIGS. 3, 4 and 5 schematically illustrate the steering mechanism of the pedal boat of FIG. 1 and the operation thereof.
Figure 4:
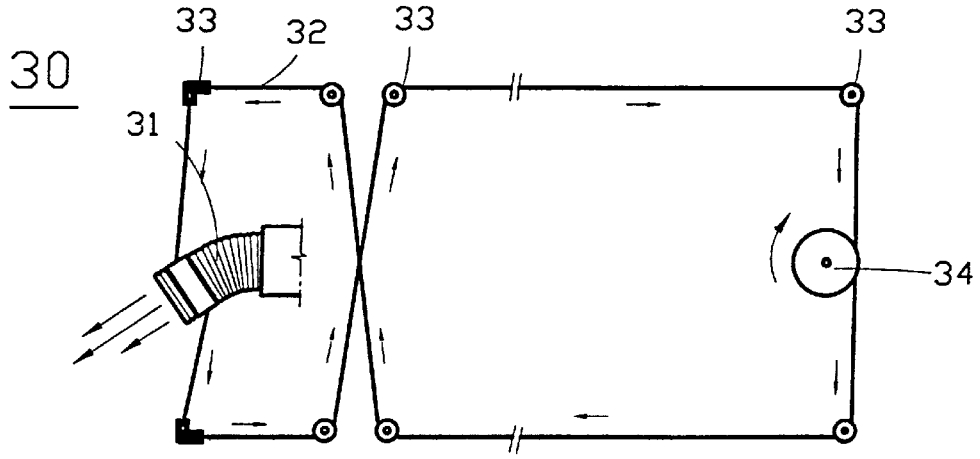
Figure 5:
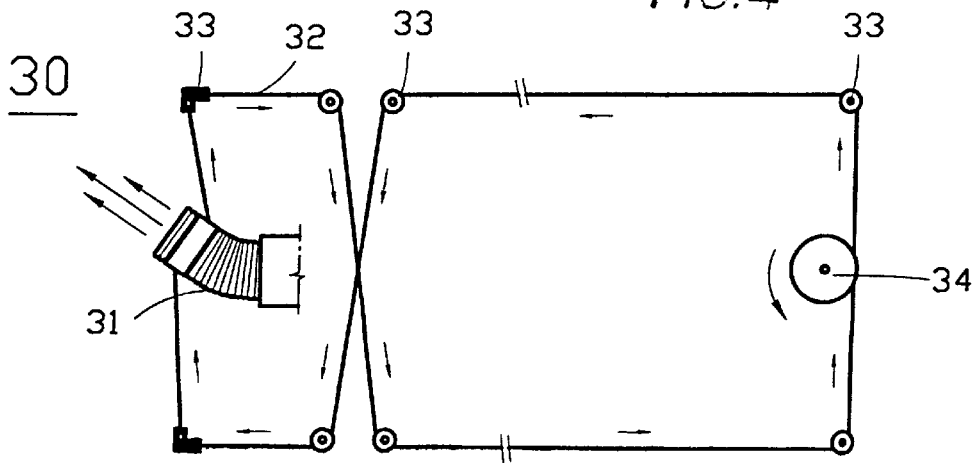

Please refer to FIGS. 1 and 2 at the same time. The transmission mechanism 20 mainly includes a driving chain wheel 21, a gearbox 22, and a propeller 23 connected to the gearbox 22 and located in the tubular member 11. Two pedals 24 are separately connected to two sides of a center of the driving chain wheel 21. Inside the gearbox 22, there are a driven chain wheel 221 cooperating with the driving chain wheel 21 and having teeth less than that of the driving chain wheel 21, a first gear 222 coaxial with the driven chain wheel 221 and having teeth more than that of the driven chain wheel 221, a second gear 223 meshing with the first gear 222 and having teeth less than that of the first gear 222, a third gear 224 coaxial with the second gear 223 and having teeth more than that of the second gear 223, a fourth gear 225 meshing with the third gear 224 and having teeth less than that of the third gear 224, a first bevel gear 226 coaxial with the fourth gear 225, and a second bevel gear 227 meshing with the first bevel gear 226. The second bevel gear 227 is supported on one end of a shaft 228 that extends through the bearing support 13 to connect to the propeller 23. When the driving chain wheel 21 is caused to rotate by use of the pedals 24, it generates a power that is transmitted to the propeller 23 via the driven chain wheel 221 and the first, the second, the third, and the fourth gears 222, 223, 224, 225 and the first and the second bevel gears 226, 227 in the gearbox 22. Since the gearbox 22 provides a high transmission gear ratio, the power transmitted from the driving chain wheel 21 to the propeller 23 causes the propeller 23 to rotate at a high speed.

Please refer to FIGS. 1, 3, 4 and 5 at the same time. The steering mechanism 30 mainly includes a flexible tube 31 connected to a reduced rear end of the tubular member 11. A cord 32 is wound about a rotating disc 34 located at a front part of the boat with its two free ends separately passing a group of pulleys and being finally connected to two sides of the flexible tube 31. A steering device 35 is connected to the rotating disc 34 to upward project therefrom. By manipulating the steering device 35, the rotating disc 34 is controlled to rotate in different directions and thereby pulls the cord 32 leftward or rightward. The cord 32 being pulled in different directions in turn causes a rear end of the flexible tube 31 to swing toward different directions and at different angles of inclination.

Please refer back to FIG. 1. To operate the pedal boat of the present invention, a user may take a seat in the hull 10 and work on the pedals 24 with feet, so that the driving chain wheel 21 is brought by the pedals 24 to rotate. With the high transmission gear ratio provided by the gearbox 22, the power generated by the rotating driving chain wheel 21 is able to cause the propeller 23 to rotate at a high speed and constantly expels water from the tubular member 11 via the flexible tube 31 connected to the rear end of the tubular member 11. The water expelled from the rear end of the tubular member 11 and the flexible tube 31 generates a push force that pushes the pedal boat forward. Since the tubular member 11 is gradually reduced from its front to the rear end, water in the tubular member 11 is compressed before being expelled from the tubular member 11. That is, the propeller 23 works in the rearward reduced tubular member 11 in a manner similar to a turbine wheel. Meanwhile, since the flexible tube 31 of the steering mechanism 30 is connected to the rear end of the tubular member 11 and the water in the tubular member 11 would be expelled via the flexible tube 31, the swing direction of the flexible tube 31 caused by turning the steering device 35 can determine the direction in which the pedal boat moves.

To enable the propeller 23 to keep rotating after the user has stopped pedaling the pedal boat, a one-way ratchet wheel may be mounted on one of the gears in the gearbox 22 and flywheels 229 may be coaxially connected to the gear having the one-way ratchet wheel to keep the propeller 23 rotate under rotational inertia.

An air duct 16 may be extended at a lower end into a front portion of the tubular member 11 with an upper end thereof projected from a top of the hull 10, so that air may be guided into the tubular member 11 via the air duct 16 to enhance water compression in the tubular member 11.

The present invention employs simple structure to largely increase the moving speed of the pedal boat and therefore makes the pedal boat more interesting for use. Meanwhile, the propeller 23, the tubular member 11, and the flexible tube 31 for propelling the pedal boat through the water all are located under the water and would not splash water about when they work to propel the pedal boat. Since the pedal boat of the present invention is driven by physical strength, it also provides a very good means for users to train themselves for good physical condition.

Since designs of the pedal boat about its braking and waterproof ability and the structural design of the flywheel are prior arts, they are not repeated herein.

What is claimed is:

1. A pedal boat comprising a hull including a lower rear portion, said hull equipped with a propeller and a transmission mechanism for rotating said propeller for propelling said pedal boat and a steering mechanism for controlling direction in which said pedal boat moves; a tubular member having a forward facing opening and a reduced rear end portion disposed below said rear portion of said hull and said lower rear portion of said hull defining a concavely curved surface facing said forward facing opening of said tubular member and forming a flow guiding surface for guiding water near a bottom of said hull into said tubular member; said tubular member having a length greater than it's diameter; and a bearing support mounted on said flow-guiding surface inside said hull for a bearing. and a water tight washer mounted thereto; and said transmission mechanism including a driving chain wheel, a gear box and a propeller located in said tubular member and connected to said gear box via a shaft extending through said bearing support, two pedals being separably connected to two sides of a center of said driving chain wheel for a user to pedal and thereby rotate said driving chain wheel; said gear box including gears for providing a high transmission gear ratio to transmit power generated by said driving chain wheel and rotating said propeller and to cause said propeller to rotate at high speed, said propeller being rotated at high speed being capable of expelling water from said tubular member via a rear end thereof, and water expelled from said tubular member propelling said pedal boat forward; and wherein said steering mechanism comprises a flexible tube connected to said reduced rear end portion of said tubular member, a rotating disk having a steering device connected thereto and upward projected therefrom, a group of pulleys, and a cord wrapped around said rotating disk and passing said group of pulleys with two free ends thereof fixed to two sides of said flexible tube; whereby by rotating said rotating disk by said steering device, said cord is pulled leftward or rightward to swing said flexible tube in different directions for deciding directions in which water is expelled from said tubular member and directions in which said pedal boat moves.

2. A pedal boat as claimed in claim 1, wherein said gearbox includes a one-way ratchet wheel mounted on one of said gears in said gearbox and flywheels coaxially connected to the gear having said one-way ratchet wheel, so that a rotational inertia is produced to keep said propeller rotating after a user has stopped working on said pedals.

3. A pedal boat as claimed in claim 1, wherein an air duct is extended at a lower end into said tubular member with an upper end projected from a top of said hull for guiding air into said tubular member.

4. A pedal boat as claimed in claim 2, wherein an air duct is extended at a lower end and into said tubular member with an upper end projected from a top of said hull for guiding air into said tubular member.

* * * * *